United States Patent [19]

Chen

[11] Patent Number: 4,865,065

[45] Date of Patent: Sep. 12, 1989

[54] HEIGHT-ADJUSTABLE CRUTCH

[75] Inventor: Charles Chen, Taipei, Taiwan

[73] Assignee: Cypress Medical Products Ltd., Buffalo Grove, Ill.

[21] Appl. No.: 259,364

[22] Filed: Oct. 18, 1988

[51] Int. Cl.[4] ..... A61H 3/02

[52] U.S. Cl. ..... 135/69; 135/75; 135/68

[58] Field of Search ..... 135/75, 69, 68; 403/100, 102, 327, 322; 248.0/188.5

[56] References Cited

U.S. PATENT DOCUMENTS

| | | | |
|---|---|---|---|
| Re. 32,815 | 1/1989 | Smith | 135/69 |
| 4,509,741 | 4/1985 | Smith | 272/69 |
| 4,566,474 | 1/1986 | Burke | 135/69 |
| 4,721,125 | 1/1988 | Wang-Lee | 135/75 X |
| 4,733,682 | 3/1988 | Ellena | 135/69 |
| 4,763,680 | 8/1988 | Acosta, Sr. | 135/69 X |

FOREIGN PATENT DOCUMENTS

| | | | |
|---|---|---|---|
| 2822850 | 11/1979 | Fed. Rep. of Germany | 135/69 |

*Primary Examiner*—David A. Scherbel
*Assistant Examiner*—Lan Mai
*Attorney, Agent, or Firm*—Milton S. Gerstein; Marvin N. Benn

[57] ABSTRACT

An improved height-adjustable crutch is provided in which the central carrier member, in which is telescopingly received an extensible leg member, is provided with laterally extending ribbed members, defining exterior concave surface, which matingly received therein the cylindrical portions of the diametrically-opposed tubes defining the lower extremity of the crutch proper. Each tube is coupled to a respective one of the ribbed members via a rivet, each rivet being independent of the other, so as to not to obstruct the interior, hollow passageway formed by the central carrier member, to allow for the sliding movement of the leg member in the central carrier member. Each ribbed member defines an arcuate interior opening having a diametric expanse less than that of a detent sphere used for retaining the extensible leg member within the hollow interior at a desired height level thereof, so as to allow for the rotation of the extensible leg member in the hollow interior during readjustment of the extensible leg member to a desired height. Each ribbed member substantially extends along the entire length of the lateral surface of the central carrier member.

6 Claims, 1 Drawing Sheet

HEIGHT-ADJUSTABLE CRUTCH

BACKGROUND OF THE INVENTION

The present invention is directed to a crutch, the leg portion of which is adjustable in height, as disclosed in U.S. Pat. No. 4,509,741-Smith. Said patent discloses a height-adjustable crutch in which the extensible leg member is telescopingly received within a hollow, cylindrical carrier member in which are provided a plurality of circular openings in which may be received a spring biased detent secured to an upper portion of the extensible leg member, in order to position the leg member at a desired position with respect to the carrier member, and thereby adjust the height of the crutch to suit the particular height necessary for the person using the crutch. The carrier member is secured to the remainder of the crutch, which remainder includes the crutch bow arm support and the like, via a pair of side tubings, each side tubing being secured to an integrally-formed mounting member which defines three substantially circular openings, two outer ones in which are received the two side tubings, and a central one in which is received a portion of the carrier member. This integrally-formed mounting member mounts the side tubings to the carrier member, with the side tubings being screwed or otherwise fastened to the integrally-formed mounting member. The side tubings are not directly and fixedly secured to the central carrier member, but secured only via the connection achieved by the integrally-formed mounting member. This integrally-formed mounting member, as disclosed in said patent, is made of hard plastic, and if such were to crack, fracture, or the like, the crutch thereof would be rendered useless. Said patent was an improvement over the prior art crutch set forth in said patent, in that it did away with the mating curved surfaces between the carrier member and the lower non-tubular extremities of the crutch.

The present invention is directed to an improvement over such height-adjustable crutch.

SUMMARY OF THE INVENTION

It is, therefore, the primary objective of the present invention to provide an improved height-adjustable crutch that is less prone to wear and tear and breakage thereof, specifically at the connections between the side tubings and the central carrier member.

It is another objective of the present invention to provide an improved height-adjustable crutch which strengthens the connections between the side tubings and the central carrier member, so as to substantially eliminate the possibility of breakage of such connection during normal use.

It is yet another objective of the present invention to increase the structural integrity of the connection between the central carrier member and the side tubings by completely eliminating the use of plastic material for such connection with the use of hard aluminum or other metals or alloys, in order to provide greater strength, stiffness, and durability.

Toward these and other ends, the improved heightadjustable crutch of the invention provides a central carrier member, which central carrier member defines a substantially hollow cylindrical interior in which is telescopingly received a circular cross-sectioned extensible leg member, the central carrier member being provided, in a conventional manner, with a plurality of vertically spaced-apart holes on two diametrically-opposed surfaces thereof, in which any two aligned and oppositely-disposed holes thereof may be positioned a spring-biased detent member provided in the extensible leg member for securement to a particular height thereof, in the well known and conventional manner as set forth in U.S. Pat. No. 4,509,741. The central carrier member, however, according to the invention, is provided on each of the two diametricallyopposed surfaces thereof, different from the diametricallyopposed surfaces containing therein the series of openings or holes, with a laterally-projecting ribbed member, defining an exterior concave surface which is nestled in mating relationship with a portion of the convex outer surfaces of a respective side tubing, which side tubing forms an extension of the crutch. The lower portion of each side tubing is secured directly and only to a respective laterally-projecting ribbed member via a rivet passing entirely through the respective side tubing and secured to the interior surface of the concave surface of the respective ribbed member. Such a connection uses metal-to-metal securement, as opposed to the plastic-to-metal securement of the prior art, as well as increasing the surface contact between the side tubing and the central carrier member, all of which add to the stiffness, structural integrity, and durability of the crutch of the invention.

BRIEF DESCRIPTION OF THE DRAWINGS

The invention wil be more readily understood with reference to the accompanying drawings, wherein.

DETAILED DESCRIPTION OF THE INVENTION

Figure 1:
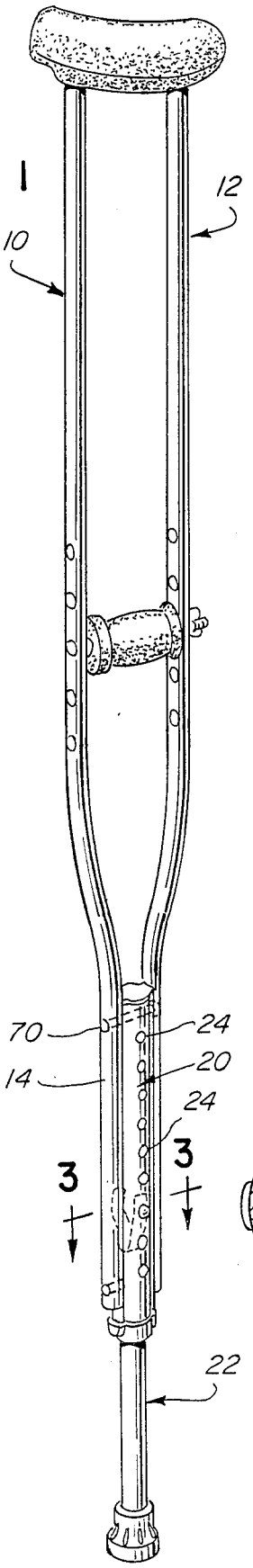
FIG. 1 is an isometric view of the improved heightadjusting crutch of the invention.
Figure 2:
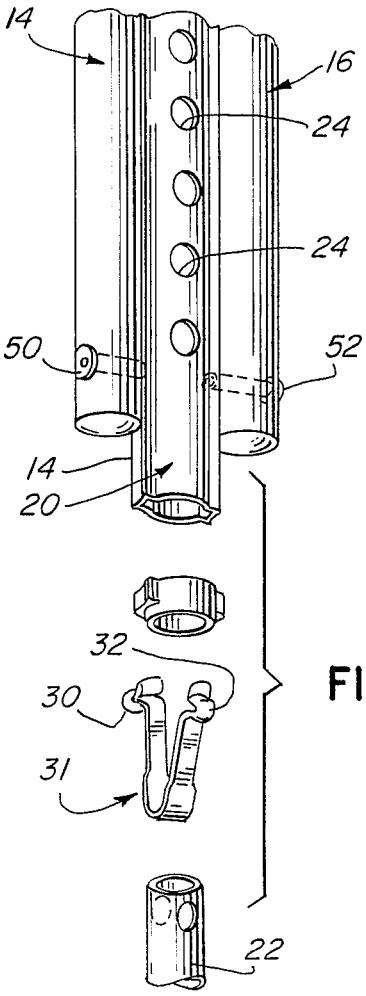
FIG. 2 is a partial assembly view of the lower portion thereof incorporating the improvements of the invention.
Figure 3:
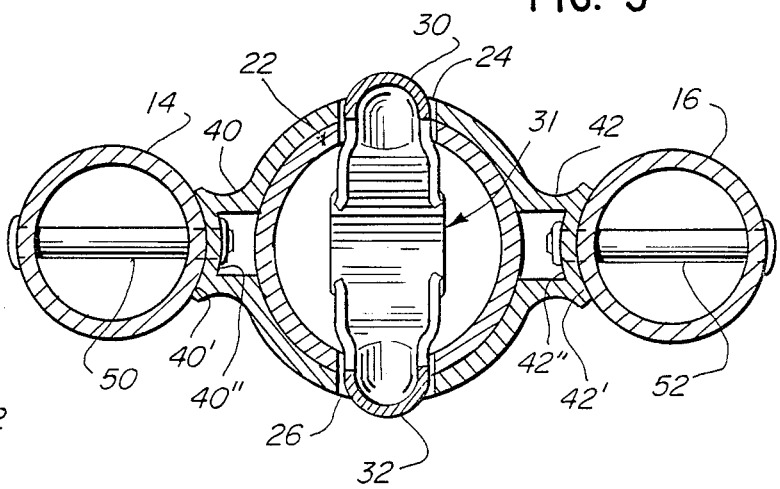
FIG. 3 is a cross-sectional view taken along line 3—3 of FIG. 1.

Referring now to the drawing in greater detail, the improved height-adjustable crutch of the present invention is indicated generally by reference numeral 10 in the drawing. The crutch 10 includes a conventional frame 12, the lower extremities of which define a pair of circular cross-sectioned hollow tubings 14, 16. Sandwiched therebetween is an elongated, hollow cylindrical carrier member 20 defining a substantially circular hollow interior for most of the interior circumference thereof, which carrier member telescopingly receives therein a lower, extensible leg support member 22, which is adjustably positionable within the central carrier 20 for adjusting the height of the overall crutch. Such adjustability is achieved via a plurality of linearly and vertically arranged through openings 24 formed in the frontquarter surface of the carrier member, and a plurality of similar and diametricaly juxtapositioned through openings or holes 26 formed in the rear-quarter exterior surface of the carrier member 16. The extensible leg member 22 incorporates a pair of spring-biased detents 30, 32 of a detent member 31, which are respectively received in any respective pair of openings 24, 26 along the height of the carrier member 16, to thereby adjust the heigth of the crutch to the desired height of the person. As can be seen in FIGS. 1 and 3, when such detents 30, 32 are in place within respective openings 24, 26, such detents protrude outwardly therefrom to lock the extensible leg member 22 in place. To adjust the height of the extensible leg member 22, the detents 30, 32 are pressed inwardly by the fingers of the hand, and substantially simultaneously therewith the extensible leg member 22 is rotated in order to misalign the detents 30, 32 with the juxtapositioned and diametrically- opposed openings 24, 26, to thereby allow for the extensible leg member 22 to be slid in the upward or downward direction within the carrier member, without catching the holes 26, 26. When the desired height is achieved by the proper positioning of the extensible leg member 22 with respect to the central carrier member 16, the extensible leg member 22 is thereafter rotated in the opposite direction to thereby align the detents 30, 32 with the new respective pair of openings 24, 26, constituting the new adjusted height of the crutch.

According to the invention, the side tubings 14, 16 are fixedly and directly connected to the central carrier member 20 by direct metal-to-metal contact, in contradistinction to that disclosed in U.S. Pat. No. 4,509,741. Specifically, the central hollow carrier member 20 is provided with a pair of diametrically-opposed, laterally-extending ribbed members 40, 42, defining a laterally and outwardly extending concave surfaces 40', 42' along the entire length of the carrier member. The ribbed members 40, 42 are formed integrally with the remainder of the central carrier member 20, and are hollow in order to provide an entirely hollow interior carrier member 20, as clearly shown in FIG. 3. In the preferred embodiment, each ribbed member 40, 42 has a width, taken in a direction from the central carrier member 20 toward the respective side tubing 14, 16, of approximately 20% of the diameter of the circular portion of the central carrier member. That is, such dimensions are taken as follows: The diameter of the carrier member is taken between the front and rear surfaces thereof in which are formed the openings 24, 26, while the dimension of the width of a respective rib member is taken along the central, lateral bisecting plane thereof, such dimension originating from an imaginary inner circumferential surface formed if the circular portion of the central carrier member were to be extended as that shown in U.S. Pat. No. 4,509,741. It is, of course, to be understood that the relationship of the dimensions of the projection of the ribbed members, as compared to the diameter of the central carrier member, may be changed somewaht, it being understood that the preferred proportional relationship is that which has just been described. The ribbed members 40, 42 form part of the diametrically-opposed lateral side surfaces of the carrier member. The interior opening of each ribbed member 40, 42 must be limited in order to allow for the rotation of the extensible leg member 22 within the hollow interior of this carrier member 20. The angular interior opening of each of the ribbed members 40, 42 is preferably less than that defined by the detent members or detent spheres 30, 32, in order to prevent the insertion of the detents therein, so as to align the detents in a manner such that they face substantially front and rear in order to more easily slide the extensible member for reception of the detents within the respective pair of openings 24, 26. This is important after the extensible leg member 22 has already been inserted into the central carrier member so that, when one rotates the extensible leg member, the detent spheres are not caught within the interior of the ribbed members, which would prevent the rotation of the extensible leg members and the subsequent readjustment of the crutch. Thus, the entire interior opening of each ribbed member 40, 42 has an arcuate expanse or extent less than that of the spherical balls 30, 32, to prevent entry of these balls therein. The ribbed members 40, 42 serve the dual purpose of adding structural integrity and reinforcement to the central carrier member 20 and, as described above, for fixed and sure connection to the side tubing 14 and 16, as opposed to the prior art crutches. Each of the side tubings 14, 16 is cylindrical in shape, and defines a convex outer surface, a portion of which is matingly received against a respective concave surface 40', 42' of the ribbed members 40, 42, for increasing the surface contact therewith and the subsequent, concomitant enhanced rigidity associated therewith. Each of the side tubings 14, 16 is independently connected to a respective rib member 14, 40, 42, by a rivet 50, 52. Each rivet 50, 52 passes entirely through the respective side tubing 14, 16, and has its interior end secured to the interior concave surface of the ribbed member, indicated by reference numerals 40", 42". Thus, each side tubing 14, 16 is independently connected to the central carrier member 20. Each ribbed member 40, 42 extends the entire length of the central carrier member 20, so that the increased surface contact between the central carrier member and the respective side tubing provides a very strong and stiff connection. Furthermore, the ribbed members 40, 42 add stiffness and structural integrity to the central carrier member 20, by providing greater impact resistance and greater load bearing capabilities. Each upper end portion of the side tubings 14, 16 is connected to the upper portion of the central carrier member 20 via a rivet bolt, which is conventional. Thus, it may be seen that the ribbed members 40, 42 add structural integrity not only to the connections between the side tubings 14 and 16 and the central carrier member 20, but also to the central carrier member 20 itself, with the individual rivets 50 and 52 achieving the securement for greater surface-to-surface contact between the respective tubings 14, 16 and the respective ribbed member 40, 42, without the rivets interfering with the insertion of the extensible leg member in the hollow interior of the central carrier member 20, while at the same time preventing interference with the rotation of the extensible leg member during repositioning thereof within the hollow central carrier member, which is achieved via the limitation of providing an arcuate ribbed member 40, 42, having an arcuate length less than that defined by the detent balls 30, 32 of the extensible leg member.

While a specific embodiment of the invention has been shown and described, it is to be understood that numerous changes, modifications and alterations thereof may be made without departing from the scope, spirit and intent of the invention as set forth in the appended claims.

What is claimed:

1. In a height-adjustable crutch comprising a main frame having a lower extremity, said lower extremity comprising a first and second side tube, a central hollow carrier member, and an extensible and retractable leg support member for telescoping reception in said central carrier member, said central carrier member comprising a front quarter-surface and a rear quarter-surface, said front quarter-surface comprising a plurality of through-openings therein, and said rear quarter-surface comprising a plurality of through-openings therein, said front quarter-surface and said rear quarter-surface being in diametrically-opposed relationship, said leg support member comprising a pair of detent means for operational engagement in a respective pair of through- openings formed in said front quarter-surface and said rear quarter-surface, whereby the height of said crutch may be adjusted depending upon which pair of through-openings said detent means is in operational engagement, the improvement comprising:

said central carrier member comprising a first lateral quarter-surface and a second lateral quarter-surface, a first elongated ribbed member forming part of said first lateral quarter-surface, and a second elongated ribbed member forming part of said second lateral quarter-surface;

each of said first and second elongated ribbed members defining an exterior concave surface, a respective one of said side tubes being matingly juxtapositioned against said exterior concave surface of a respective said first and second elongated ribbed member, said mating relationship occurring between a respective said exterior concave surface and a circumferential portion of said respective first and second tube;

each of said first and second ribbed members defining a hollow interior, said hollow interior of each of said first and second ribbed members cooperating with the hollow interior of the remainder of said central carrier member, whereby said extensible leg member may be reciprocated within said hollow interior of said central carrier member in an unrestricted manner;

a first means for securing said first side tube to said first ribbed member, and a second means for securing said second ribbed member to said second side tube, said first and second means for securing being separate and independent of each other, a respective inner end of each of said first and second means for securing being fixedly secured to a portion of a respective one of said first and second ribbed members, whereby structural integrity and stiffness is provided to the crutch.

2. The improvement according to claim 1, wherein each of said first and second means for securing comprises a rivet, each said rivet comprising an exterior end abutting against a cylindrical outer surface portion of a respective said side tube, said interior end therof being connected to an inner convex surface of a respective said elongated ribbed member.

3. The improvement according to claim 2, wherein each said rivet connects a lower portion of a respective one of said first and second side tubes to a lower portion of said central carrier member.

4. The improvement according to claim 3, wherein each of said first adn second ribbed members defines a hollow interior entrance having a arcuate expanse less than the diameter of a respective one of said detent means, to thereby prevent entry of said respective detent means into the hollow interior of the respective said first and second ribbed members.

5. The improvement according to claim 4, wherein each of said first and second ribbed members extends substantially the entire length of said central carrier member.

6. The improvement according to claim 4, wherein each said detent means comprises a spherical ball for entry into any of said through-openings.

* * * * *